US005092354A

United States Patent [19]

Pacelli, Jr.

[11] Patent Number: 5,092,354

[45] Date of Patent: Mar. 3, 1992

[54] COSMETIC KIT

[75] Inventor: Joseph C. Pacelli, Jr., Greenwich, Conn.

[73] Assignee: Diamond Plastics & Design, Inc., Greenwich, Conn.

[21] Appl. No.: 711,772

[22] Filed: Jun. 7, 1991

[51] Int. Cl.[5] ..... A45D 33/26

[52] U.S. Cl. ..... 132/294; 132/315; 206/581; 206/823

[58] Field of Search ..... 132/293, 294, 295, 296, 132/301, 314, 315; 206/581, 823

[56] References Cited

U.S. PATENT DOCUMENTS

| | | | |
|---|---|---|---|
| 1,986,057 | 1/1935 | Hackworth | 132/315 |
| 2,761,458 | 9/1956 | Werber | 132/315 |
| 3,592,201 | 7/1971 | Haddaway | 132/301 |
| 4,331,168 | 5/1982 | Hatakeyama | 206/581 |
| 4,538,725 | 9/1985 | Glover et al. | 132/294 |
| 4,589,430 | 5/1986 | Sussman | 132/294 |
| 4,684,017 | 8/1927 | Watanabe et al. | 206/581 |
| 4,951,692 | 8/1990 | Yuhara et al. | 132/294 |
| 4,972,860 | 11/1990 | Yuhara et al. | 132/293 |

FOREIGN PATENT DOCUMENTS

| | | | |
|---|---|---|---|
| 0081901 | 6/1983 | European Pat. Off. | 132/294 |

*Primary Examiner*—Gene Mancene
*Assistant Examiner*—Frank A. LaViola
*Attorney, Agent, or Firm*—Henderson & Sturm

[57] ABSTRACT

A cosmetic or make-up kit is provided with improved structure for releaseably carrying plurality of receptacles or godets for replacement, interchangeability and the like whereby to increase the flexibility of the kit and adapt it more readily to the needs and wishes of the user. The arrangement is such that each godet includes a resilient, depending resilient element that engages a continuous ledge in the base structure, the continuous ledge providing for the receipt of godets of different dimensions.

7 Claims, 2 Drawing Sheets

Fig. 1
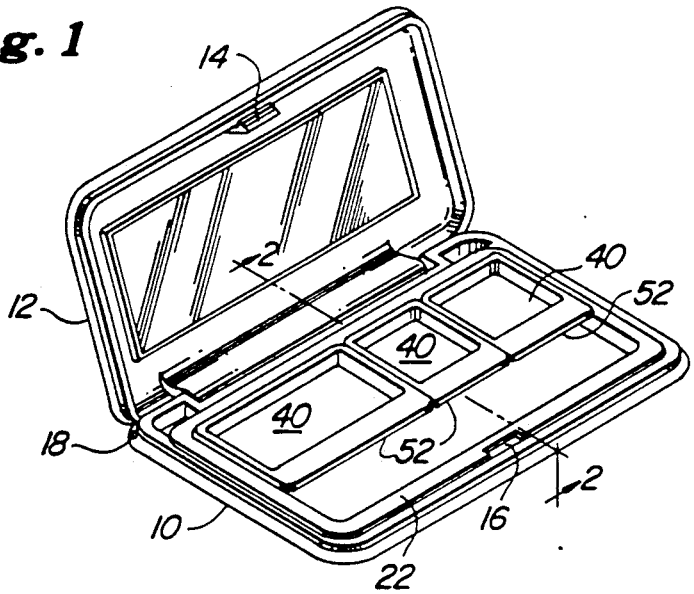
Fig. 2
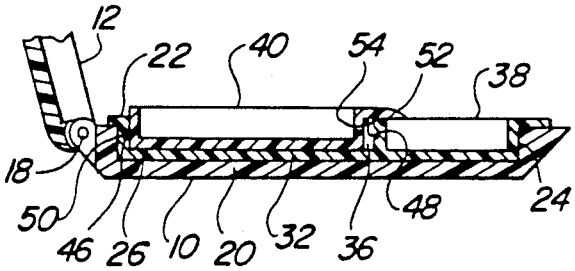
Fig. 3
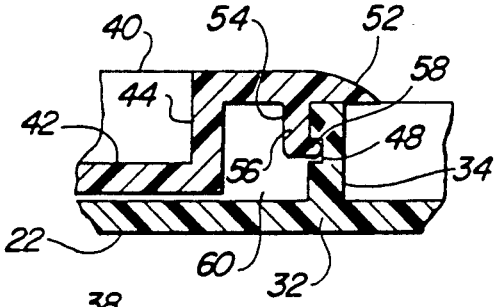
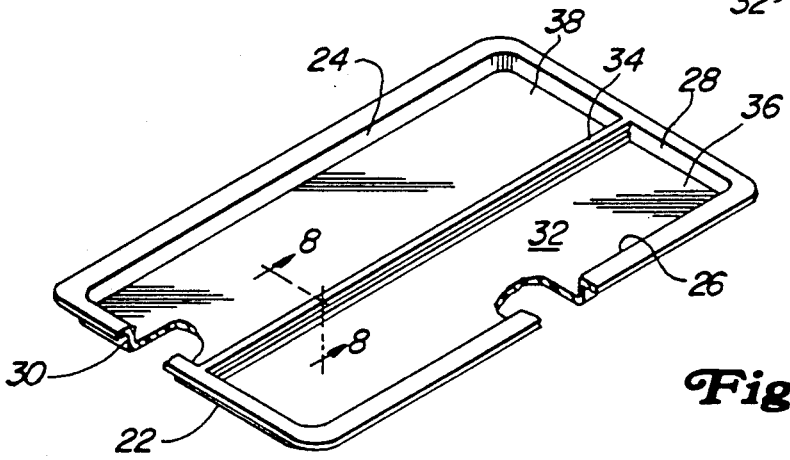
Fig. 4

Fig. 5
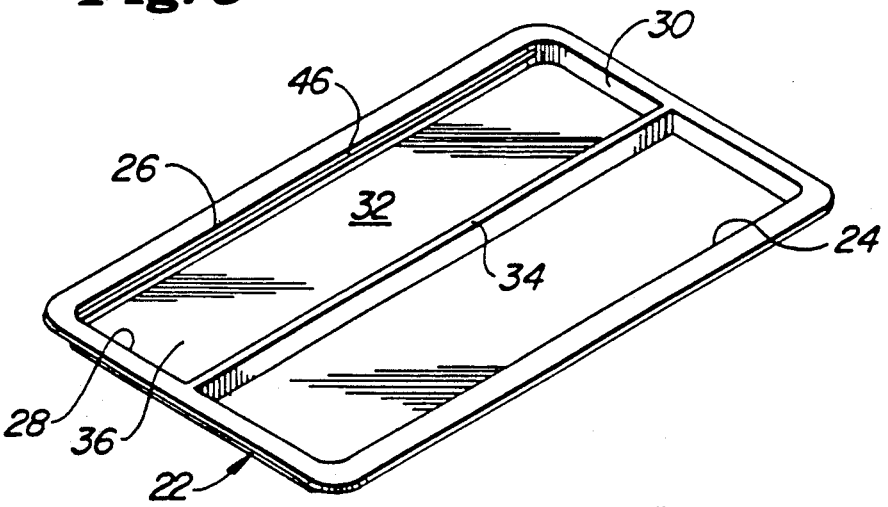
Fig. 8
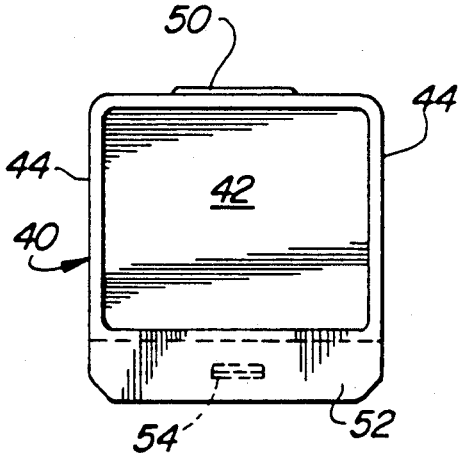
Fig. 6
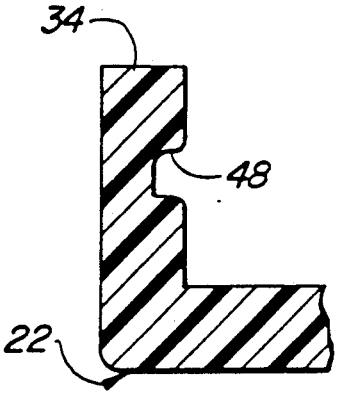
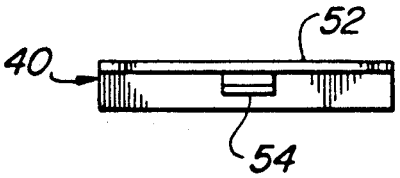
Fig. 7
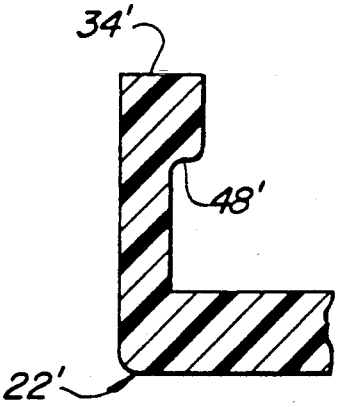
Fig. 9

COSMETIC KIT

BACKGROUND AND SUMMARY OF THE INVENTION

It is commonplace to provide make-up and cosmetic kits of the type comprising a rectangular base and complementary cover in which the base includes compartments for receiving removable receptacles or godets containing different types, colors, etc. of cosmetics, and the receptacles are removable for replenishment of the cosmetic, replacement by a different cosmetic, color, etc. Along with the removable godets, it is typical of a kit to include an elongated compartment for applicators, brushes, etc. Representative art includes the U.S. Pat. No. 4,589,430 to Sussman.

Among the disadvantages of prior art kits is the difficulty of providing a simple, releasable connection between the base structure and the godets. It is desirable that the connection be such as to normally retain the godet yet to permit easy release by the finger of the user, i.e. without tools and the like. The connection should also be universal to the extent that replacement godets of different sizes are readily receivable in the base structure. Since there is no predetermined locator the godet can be placed in any position thus allowing for any custom size godet. Still further, the connection should lend itself to simple and easy manufacture so as to increase the utility of the kit while reducing manufacturing and distribution costs.

The present invention eliminates the past disadvantages and problems by means of providing the base structure with a continuous ledge for receiving rear tabs or the like on the godets, as distinguished from spaced apart notches, for example which require relatively precision manufacture to obtain the proper spacing, especially where godets of different dimensions are employed. Further, the front of each godet is formed with a depending, resilient flex tab or hook element which is biased into engagement with a continuous ledge along the interior front wall of the base structure compartment or cavity the bias being relatively easily overcome by a manual lifting force on a lip or projection at the front of the godet.

These and other significant features of the invention will appear as a preferred embodiment of the invention is disclosed herein in conjunction with the accompanying drawings.

DESCRIPTION OF THE DRAWINGS

FIG. 1 is a perspective of the improved kit with the cover opened to expose the interior components.

FIG. 2 is an enlarged section on the line 2—2 of FIG. 1.

FIG. 3 is a further enlarged section of a forward portion of the relationship between the godet and the base structure.

FIG. 4 is a perspective of the base structure insert as seen from the rear and looking forwardly.

FIG. 5 is a similar view as seen from the front and looking rearwardly.

FIG. 6 is a plan view of a godet.

FIG. 7 is a front view of the same.

FIG. 8 is a section on the line 8—8 of FIG. 4.

FIG. 9 is a section like FIG. 8 but shows a different form of godet-receiving ledge means.

DETAILED DESCRIPTION OF A PREFERRED EMBODIMENT OF THE INVENTION

Reference will be had to FIG. 1 for an overview of what is involved basically. In that Figure, a representative novel kit is shown as having a base structure 10 and a complementary cover 12 shown in its open position. When the cover is closed it is latched to the base structure by a suitable means, suggested at 14 and 16. The cover is shown as hinged to the base structure at 18, a typical arrangement.

As best seen in FIG. 2, the base structure here is made up of a box-like bottom 20 and an insert or tray 22 which may be removable from the base bottom or which may be affixed to the bottom in any known manner. Further, the tray may be an integral part of the base but is preferably molded separately for ease in manufacture. The tray is separate from the bottom as seen in FIGS. 4 and 5 and is essentially rectangular, of molded plastic, for example, having front and rear walls 24 and 26, respectively, opposite end walls 28 and 30, a floor 32 and a lengthwise partition 34 that gives the tray a somewhat large rear cavity or compartment 36 and a smaller front compartment 38. The rear compartment is seen as accommodating a plurality (here three) of receptacles or godets 40, here of like size; although, as will appear subsequently herein, various sizes of godets will fit the rear compartment. Each godet is shown here as a box-like element of suitable material, such as plastic, having a floor 42 and surrounding walls 44. The godets are shown empty, since the particular contents are of no patentable significance.

The retaining means for the godets will now be described. The front face of the rear wall 26 of the tray 22 has formed therein a longitudinal groove 46 running lengthwise continuously of the wall and opening forwardly toward the rear cavity or compartment 36, the upper marginal edge of the groove forming a continuous, forwardly projecting ledge for purposes to appear. The rear face of the partition 34 has a similar groove 48 facing rearwardly. As seen in FIG. 9, the grooves may be formed instead as ledges, as at 48' in the partition 34' of a tray 22'. Each godet has at its rear wall an integral ear or lug 50 which, when the godet is installed, fits into the groove 46 and thus under the ledge formed by the upper edge of the groove. The ear or lug can be made much longer cross-wise of the godet, because of the length of the groove 46 and thus is stronger than several shorter ears. The fore-and-aft dimension of the godet is such that front part thereof cooperates with the rear of the partition 34 (FIGS. 2 and 3). Specifically, the front part of the godet, as at 52, overhangs the partition to afford a lifting lip for facilitating manual lifting of the godet. Integrally formed as part of the godet front portion is a depending resilient flex tab or hook element 54 that is biased forwardly to engage with the groove 48 in the partition. The element 54 comprises a leg 56 having an integral forwardly projecting toe 58 of rounded shape so as to disengage from the groove when manual lifting force is applied to the godet lip 52. The front wall 44 of the godet depends in rearwardly spaced relation to the flex tab element to complete the compartment of the godet as well as to afford space 60 for the hook element to yield rearwardly for release. This front wall also adds to the strength of the front of the godet so far as concerns lifting force applied in removal of the godet.

A significant advantage of the continuous grooves 46 and 48 is that they are more easily formed during manufacture. Further, being continuous, they avoid the requirement for precision spacing according to the rear lugs on the godets, because the lug will fit anywhere along the groove. The same applies to the relationship of the hook elements to the forward or partition groove 48.

It will be seen from the foregoing the ten improved cosmetic or make-up kit has been provided, featuring novel and improved connection means between the base structure and godets carried thereby. Features and advantages not specifically pointed out in the foregoing will have become apparent to those versed in the art, as will numerous alterations in and additions to the preferred embodiment disclosed, all without departure from the spirit and scope of the invention.

The hook or tab elements are extremely resistent to breakage despite repeated removal and replacement of the godets.

I claim:

1. A cosmetic kit comprising a rectangular base structure and a complementary cover therefor, said base structure having front and rear and opposite end walls defining a box-like cavity, said rear wall having integrally therewith an interior rear ledge running continuously lengthwise thereof and projecting a short distance forwardly into the cavity, said front wall having integrally therewith an interior front ledge running continuously lengthwise thereof and projecting a short distance rearwardly into the cavity, and a receptacle received within the cavity between the ledges, said receptacle having rear engaging means fitting under a portion of the rear ledge and front means cooperative with the front ledge, said front engaging means including a front portion forwardly overhanging the front wall and a resilient element integral with said front portion and depending therefrom closely behind the front wall and biased forwardly to releasably engage the front ledge.

2. A cosmetic kit according to claim 1, in which each of the front and rear walls has a groove therein, each groove has an upper marginal edge and said marginal edges provide the respective ledges.

3. A cosmetic kit according to claim 1, in which the base structure includes a bottom and a tray fitting therewithin and the tray has the front and rear ledges therein.

4. A cosmetic kit according to claim 1, in which the overhanging portions on the receptacle is relatively rigid and serves as lift tab for lifting the receptacle from the cavity and the resilient element is configured to release from the front ledge in response to upward force applied to the tab.

5. A cosmetic kit according to claim 1, in which the resilient element comprises a relatively vertically elongated resilient leg and an integral toe projecting forwardly to fit under the front ledge.

6. A cosmetic kit according to claim 1, in which the receptacle has a front wall spaced closely behind the resilient element and providing space for the resilient element to move rearwardly for release from the front ledge.

7. A cosmetic kit comprising a rectangular base structure and a complementary cover therefor, said base structure having front and rear and opposite end walls defining a box-like cavity, said rear wall having integrally therewith an interior rear ledge projecting a short distance forwardly into the cavity, said front wall having integrally therewith an interior front ledge projecting a short distance rearwardly into the cavity, and a receptacle received within the cavity between the ledges, said receptacle having rear engaging means fitting under a portion of the rear ledge and front engaging means cooperative with the front ledge, said front means including a front portion forwardly overhanging the front wall and a resilient element integral with said front portion and depending therefrom closely behind the front wall and biased forwardly to releasably engage the front ledge and the receptacle has a front wall spaced closely behind the resilient element and providing space for the resilient element to move rearwardly for release from the front ledge.

* * * * *